US006042431A

United States Patent [19]

Hayakawa

[11] Patent Number: 6,042,431

[45] Date of Patent: Mar. 28, 2000

[54] JOINT DEVICE FOR AN AUTOMOTIVE WIRING HARNESS

[75] Inventor: Hirohito Hayakawa, Yokkaichi, Japan

[73] Assignee: Sumitomo Wiring Systems, Ltd., Japan

[21] Appl. No.: 09/124,380

[22] Filed: Jul. 28, 1998

[30] Foreign Application Priority Data

Jul. 30, 1997 [JP] Japan ..... 9-204308

[51] Int. Cl.[7] ..... H01R 4/30

[52] U.S. Cl. ..... 439/801; 439/883

[58] Field of Search ..... 439/801, 804, 439/805, 810, 817, 865, 868, 883

[56] References Cited

U.S. PATENT DOCUMENTS

| | | | |
|---|---|---|---|
| 4,775,339 | 10/1988 | Sasaki et al. . | |
| 4,832,629 | 5/1989 | Sasaki et al. | 439/889 |
| 5,292,264 | 3/1994 | Blank | 439/813 |
| 5,529,509 | 6/1996 | Hayes et al. . | |

FOREIGN PATENT DOCUMENTS

| | | |
|---|---|---|
| 2 693 842 | 1/1994 | France . |
| 1 640 030 | 11/1970 | Germany . |
| 6-17122 | 3/1994 | Japan . |
| 7-36371 | 7/1995 | Japan . |
| 7-263059 | 10/1995 | Japan . |
| 8-236184 | 9/1996 | Japan . |
| 08268183 | 10/1996 | Japan . |

*Primary Examiner*—Lincoln Donovan
*Attorney, Agent, or Firm*—Anthony J. Casella; Gerald E. Hespos

[57] ABSTRACT

A joint device is provided to increase the number of wires connectable with one bolt. The joint device includes an insulation casing 3 with a terminal insertion opening 9. A bolt 2 projects from a bottom wall of the casing 3 and a terminal table 11 is mounted around and over the bolt 2. A mount hole 4*c* of an LA terminal 4*b* is fitted down on a shaft 2*a* of the bolt 2; and a wire 4*a* extending from the terminal 4*b* is inserted into a wire insertion slot 8*a* in the casing. Next, a second LA terminal 5*b* is inserted in a manner similar to the above. A mount hole 5*c* of the LA terminal 5*b* is fitted down on the shaft 2*a* of the bolt 2; and a wire 5*a* is inserted into an adjacent wire insertion slot 8*b*. Further, a mount hole 6*c* of a third LA terminal 6*b* is fitted down on the shaft 2*a* of the bolt 2 and a wire 6*a* is inserted into the wire insertion slot 8*a* as the wire 4*a* corresponding to the first LA terminal 4*b* and been. By alternately inserting the wires 4*a*, 5*a*, 6*a* into the respective wire insertion slots 8*a*, 8*b* in this manner, the number of wires connectable with one bolt 2 can be increased.

8 Claims, 3 Drawing Sheets

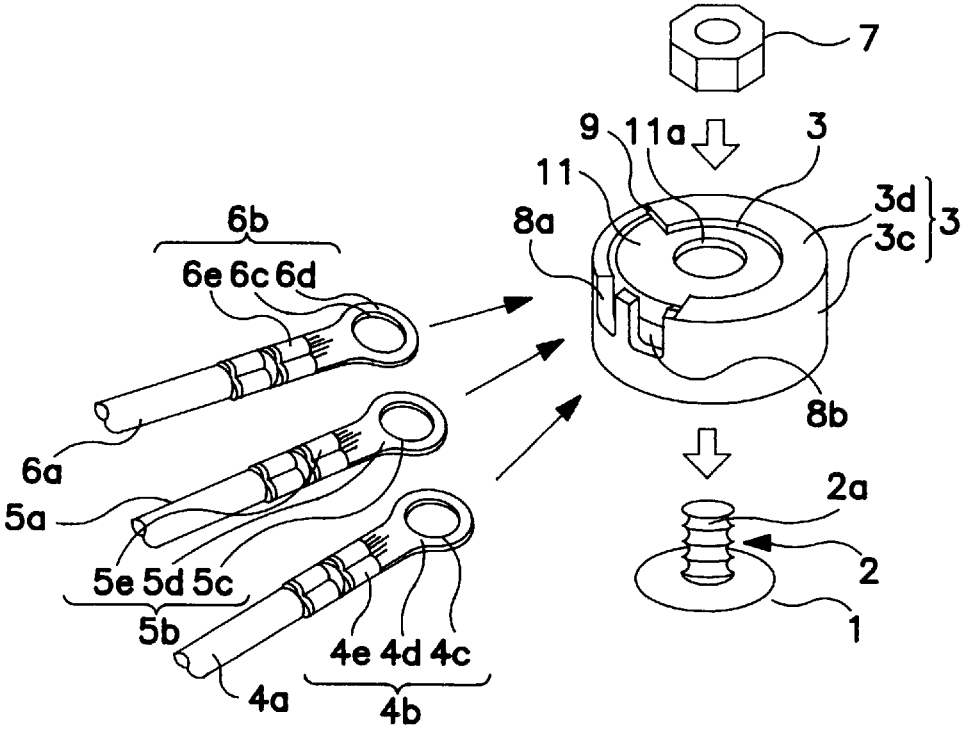
FIG. IA
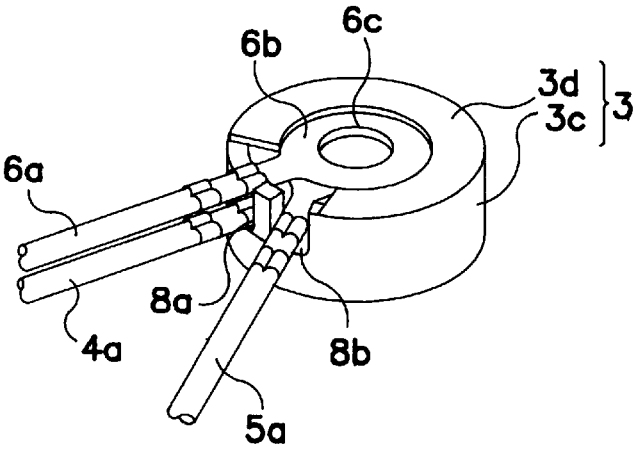
FIG. IB
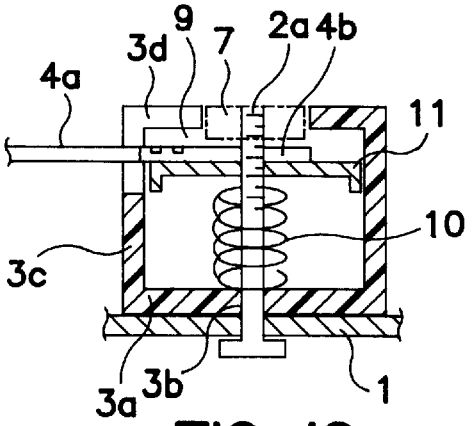
FIG. IC

JOINT DEVICE FOR AN AUTOMOTIVE WIRING HARNESS

BACKGROUND OF THE INVENTION

1. Field of the Invention

The present invention relates to a joint device for an automotive wiring harness and is particularly designed to increase the number of wires connectable with one bolt.

2. Description of the Prior Art

Wires forming an automotive wiring harness are grounded to a vehicle body by fastening terminals at ends of the wires to a bolt. Specifically, as shown in FIG. 3, a mount hole 51*a* of a prior art terminal 51 at an end of a wire 50 is fitted down on a shaft 2*a* of a bolt projecting from a vehicle body 1, and the terminal 51 is fastened by a nut 52.

The prior art terminal 51 at the end of the wire 50 is a so-called LA terminal which is provided with a substantially circular electrical contact portion 51*b* formed at the leading end, and a barrel portion 51*c* at the opposed end. A mount hole 51*a* is formed centrally through the circular contact portion 51*b*.

The terminals 51 enable two wires 50 to be connected with the shaft 2*a* of one bolt to establish a ground by putting flat surfaces of the terminals 51 together as shown in FIGS. 4(B) and 4(C). More particularly, the connection of the terminals 51 with the shaft 2*a* of the bolt requires the contact surface of the terminal 51 to be flattened to ensure a stable contact. On the other hand, one side of the barrel 51*c* of the terminal 51 inevitably has a thickness due to the diameter of the wire 50. Thus, a maximum of two wires 50 can be connected with one bolt by putting the flat surfaces of the barrel portions 51 thereof together as described above.

Accordingly, to ground three or more wires, it is necessary to employ a joint connector for accommodating a plurality of wires and combining them into one wire that can be mounted to a single bolt. Alternatively the number of bolts at the vehicle body can be increased so that no more than two wires can be connected with each bolt. A joint connector leads to an increased cost for parts and more bolts necessitates more connecting operations.

In view of the above problem, it is an object of the present invention to provide a joint device for an automotive wiring harness which increases the number of wires connectable with one bolt.

SUMMARY OF THE INVENTION

According to the invention, there is provided a joint device for an automotive wiring harness. The joint device comprises an insulation casing. A bolt having a shaft projects from the vehicle body and through a hole in the bottom wall of the insulation casing. A plurality of wire insertion slots are open to an upper wall and extend toward the bottom wall. The wire insertion slots are formed at least in a side wall of the insulation casing at predetermined or predeterminable intervals for introducing a plurality of wires thereinto. A terminal insertion opening substantially communicates with the wire insertion slots. The mount hole-provided electrical contact portions of the terminals at the ends of the wires are inserted or are insertable between the upper wall and the bottom wall of the insulation casing through the terminal insertion opening. The mount holes of the terminals are fitted or are fittable down on the bolt shaft, and the wires are inserted or are insertable into the wire insertion slots. A nut then is fastened or is fastenable to the bolt shaft with the electrical contact portions of the terminals at the ends of the plurality of wires.

With this construction, the bolt shaft projects from the bottom wall of the insulation casing and the plurality of wire insertion slots for permitting the insertion of the plurality of wires thereinto are provided in the side wall of the insulation casing at specified intervals. Accordingly, the electrical contact portions which are flat surfaces of the mount hole-provided cramping terminals at the ends of the wires can be put together (preferably on a terminal table) and, at the same time, the wires, which are unflat portions, can be dispersedly arranged in the respective wire insertion slots.

According to a preferred embodiment of the invention, the joint device further comprises a terminal table which is so mounted or mountable on the bolt shaft as to fit a through hole thereof down on the bolt shaft. The electrical contact portions are inserted or are insertable between the upper wall of the insulation casing and the terminal table through the terminal insertion opening. The joint device may further comprise a spring mounted on the bolt shaft. The terminal table may be biased in a direction to the upper wall of the insulation casing by being placed on an upper end of the spring. The nut then may be fastened to the bolt shaft with the electrical contact portions of the terminals at the ends of the plurality of wires put together on the terminal table.

The number of the wire insertion slots may be equal to the smaller one of an integer obtained by rounding up a quotient of the largest thickness of barrel portions of the terminals divided by the smallest thickness of electrical contact portions and the number of wires to be inserted.

According to a further embodiment of the invention, there is provided a joint device for an automotive wiring harness, comprising an insulation casing. A bolt having a shaft projects from a bottom wall of the insulation casing, and a spring is mounted on the bolt shaft. A terminal table is so mounted on the bolt shaft as to be biased by being placed on an upper end of the spring and by fitting a through hole thereof down on the bolt shaft. A plurality of wire insertion slots are formed in a side wall of the insulation casing at specified intervals for permitting the insertion a plurality of wires thereinto, and a terminal insertion opening communicates with the wire insertion slots. Mount hole-provided electrical contact portions of cramping terminals are secured at ends of the wires and are inserted between an upper wall of the insulation casing and the terminal table through the terminal insertion opening. The mount holes of the terminals then are fitted down on the bolt shaft, and the wires are inserted into the wire insertion slots. Finally a nut is fastened to the bolt shaft with the electrical contact portions of the cramping terminals at the ends of a plurality of wires put together on the terminal table.

The width of the plurality of wire insertion slots is set substantially equal to or larger than the diameter of the wires and the plurality of wires are alternately inserted or insertable into the respective wire insertion slots.

When the plurality of cramping terminals are put together by fitting the mount holes down on the bolt, the wire corresponding to the lower cramping terminal can be inserted into the wire insertion slot different from the one for the wire corresponding to the upper cramping terminal. Since the wires inserted into one wire insertion slot are spaced apart by the thickness of the electrical contact portion of the cramping terminal of the wire inserted into an other wire insertion slot, they do not interfere with each other. Thus, the number of wires connectable with one bolt can be increased.

Further, the plurality of cramping terminals are held by the nut while being pressed against the terminal table by the spring. Accordingly, the electrical contact portions of the plurality of cramping terminals fitted down on one bolt can be put together closely, thereby ensuring a high contact stability.

Further, since the respective wires are locked in the wire insertion slots even if a pulling force acts on the wires due to a vibration of a vehicle, the respective cramping terminals do not rotate about the bolt and a contact stability can be obtained.

Preferably, the terminal insertion opening is an opening formed in the upper wall of the insulation casing. This enables the cramping terminals to be easily inserted into the insulation casing obliquely from above.

The plurality of wires can be grounded if the bolt shaft is inserted or is insertable through a through hole formed in a vehicle body and a through hole formed in the bottom wall of the insulation casing to ground the plurality of wires.

If a head of the bolt is embedded in the bottom wall of the insulation casing in such a manner that the shaft thereof projects from the bottom wall, the plurality of wires can be electrically connected with each other.

These and other objects, features and advantages of the present invention will become more apparent upon a reading of the following detailed description and accompanying drawings.

BRIEF DESCRIPTION OF THE DRAWINGS

FIGS. 1(A), 1(B) and 1(C) are an exploded perspective view, a schematic perspective view and a section showing one embodiment of the invention.

DETAILED DESCRIPTION OF THE PREFERRED EMBODIMENTS

Figure 2:
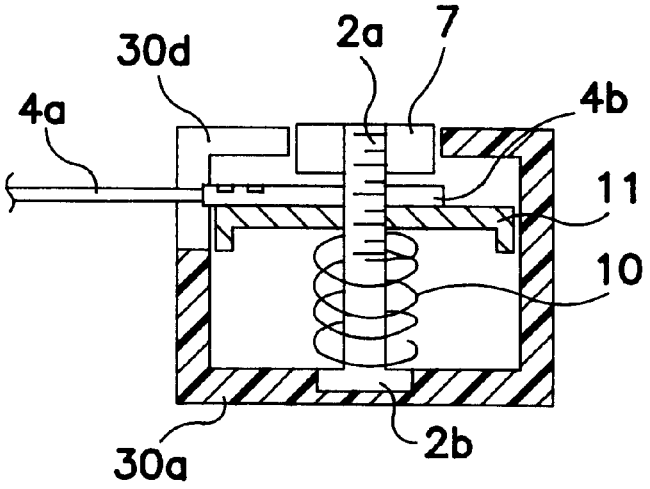
FIG. 2 is a section showing a modification of the embodiment of the invention.
Figure 3:
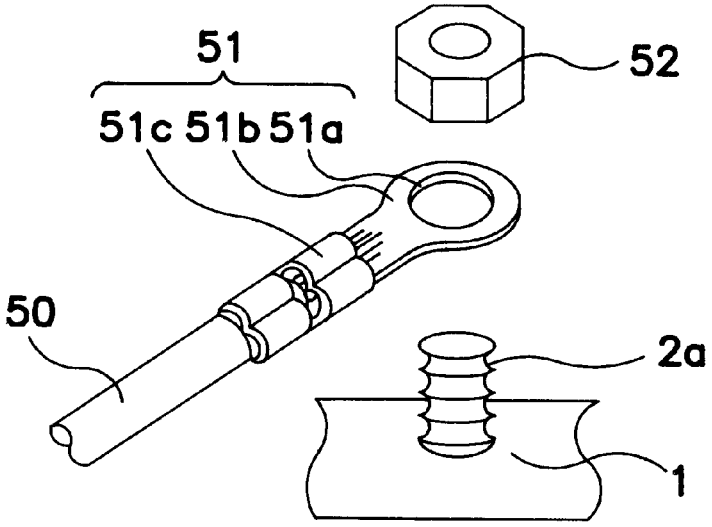
FIG. 3 PRIOR ART
FIG. 3 is a schematic diagram of a prior art.
Figure 4A:
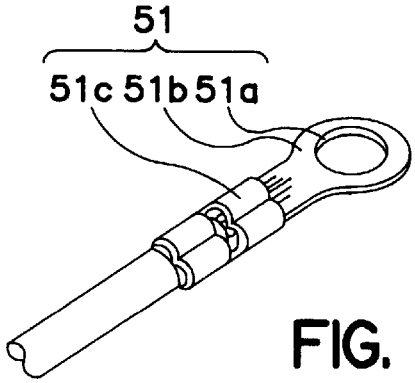
FIG. 4A PRIOR ART
FIGS. 4(A), 4(B) and 4(C) are schematic perspective views showing LA terminals.
Figure 4B:
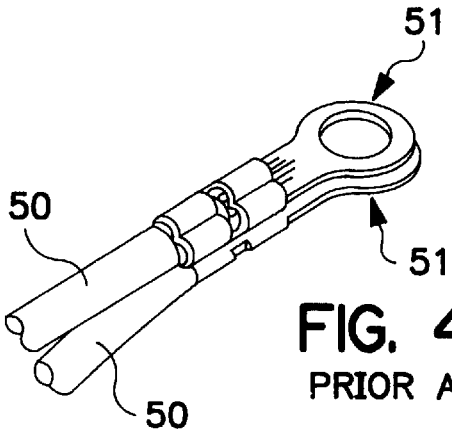
FIG. 4B PRIOR ART
Figure 4C:
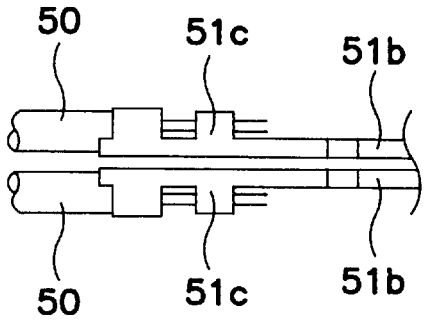
FIG. 4C PRIOR ART

As shown in FIG. 1, terminals 4*b*, 5*b*, 6*b* are cramping terminals provided with mount holes and are referred to as "LA terminals". The terminals 4*b*, 5*b* and 6*b* are at ends of wires 4*a*, 5*a*, 6*a* forming or being part of a wiring harness. The wires 4*a*, 5*a* and 6*a* are accommodated in an insulation casing 3 mounted or mountable on a shaft 2*a* of a bolt 2 projecting from a vehicle body 1 and are grounded or fixed by a nut 7.

The insulation casing 3 is a substantially cylindrical casing of metal and is formed with a bolt hole 3*b* in the center of a bottom wall 3*a*. The shape of the insulation casing 3 may be adapted or corresponding substantially to that of the cramping terminals 4*b*, 5*b*, 6*b*. The insulation casing 3 comprises two wire insertion slots 8*a*, 8*b* which are formed or cut in a side wall 3*a*. The slots 8*a*, 8*b* extend downwardly from the upper end of the casing 3 and are radially spaced apart at a predetermined or predeterminable interval. A terminal insertion opening 9 is provided in an upper wall 3*d*. The opening 9 has a diameter larger than that of the bolt hole 3*b* and is substantially in communication with the bolt hole 3*b* and the respective wire insertion slots 8*a*, 8*b*. The width of the wire insertion slots 8*a*, 8*b* is substantially equal to or larger than the diameter of wires 4*a*, 5*a*, 6*a*.

The shaft 2*a* of the bolt 2 projects from the bottom wall 3*b* in the insulation casing 3. A spring 10 is mounted or mountable on the shaft 2*a* of the bolt 2, and a through hole 11*a* of a terminal table or plate 11 then is fitted or is fittable down on the spring 10. The terminal table 11 is mounted while being spring-biased away from the bottom wall 3*b* of the insulation casing 3.

On the other hand, the LA terminals 4*b*, 5*b*, 6*b* are provided with substantially circular electrical contact portions 4*d*, 5*d*, 6*d* formed with mount holes 4*c*, 5*c*, 6*c* at their leading ends. The wires 4*a*, 5*a*, 6*a* are connected with barrel portions 4*e*, 5*e*, 6*e* provided behind the electrical contact portions 4*d*, 5*d*, 6*d*. Although one side surface of each of the LA terminals 4*b*, 5*b*, 6*b* is bulging due to the thickness of the wires 4*a*, 5*a*, 6*a*, the other side surface thereof is substantially flat.

In the above insulation casing 3, the electrical contact portion 4*d* of the LA terminal 4*b* is first inserted between the upper wall 3*d* and the terminal table 11 through the terminal insertion opening 9. Since the terminal insertion opening 9 is open in the upper wall 3*d* of the insulation casing 3, the LA terminal 4*b* easily can be inserted obliquely from above the insulation casing 3.

Then, the mount hole 4*c* of the LA terminal 4*b* is fitted down on the shaft 2*a* of the bolt 2 and the wire 4*a* is inserted into the wire insertion slot 8*a*.

Next, the second LA terminal 5*b* is inserted in a manner similar to the above. In particular, the mount hole 5*c* thereof is fitted down on the shaft 2*a* of the bolt 2, and the wire 5*a* is inserted into the adjacent wire insertion slot 8*b*. The third LA terminal 6*b* is inserted in a manner similar to the above by fitting the mount hole 6*c* down on the shaft 2*a* of the bolt 2 and inserting the wire 6*a* into the wire insertion slot 8*a* as the wire 4*a* corresponding to the first LA terminal 4*b* is.

The electrical contact portions 4*d*, 5*d*, 6*d* of the respective LA terminals 4*b*, 5*b*, 6*b* are put together by alternately inserting the wires 4*a*, 5*a*, 6*a* into the respective wire insertion slots 8*a*, 8*b*. Accordingly, the wires 4*a*, 6*a* inserted into the same wire insertion slot 8*a* do not interfere with each other since they are spaced apart by the thickness of the electrical contact portion 5*d* of the LA terminal 5*b* of the wire 5*a* inserted into the wire insertion slot 8*b*. Thus, a plurality of wires 4*a*, 5*a*, 6*a* can be inserted into one wire insertion slot 8*a* or 8*b* according to the vertical dimension of the wire insertion slots 8*a*, 8*b* in relation to the diameter of the wires 4*a*, 5*a*, 6*a*, thereby increasing the number of wires connectable with one bolt 2.

The nut 7 then is fastened to the bolt 2. At this time, the spring 10 is compressed as the nut 7 is screwed down, and the electrical contact portions 4*d*, 5*d*, 6*d* of the three LA terminals 4*b*, 5*b*, 6*b* are pressed against the terminal table 11 accordingly. In this way, the three LA terminals 4*b*, 5*b*, 6*b* can be put closely together, ensuring a higher electric contact stability.

Although the terminal insertion openings 8*a*, 8*b* are provided in the upper wall 3*d* of the insulation casing 3 in the foregoing embodiment, they may be provided in the side wall 3*c* of the insulation casing 3 (8*a*, 8*b* are actually formed in the side wall 3*c* in this embodiment as well). In such a case, slits into which the electrical contact portions 4*c*, 5*c*, 6*c* of the LA terminals 4*b*, 5*b*, 6*b* may be so formed as to be continuous with the respective wire insertion openings.

The LA terminals 4*b*, 5*b*, 6*b* are connected with the shaft 2*a* of the bolt 2 projecting from the vehicle body 1 to establish a ground in the foregoing embodiment. However, a plurality of wires can be connected electrically with each other by embedding a head 2*b* of the bolt 2 in a bottom wall 30*a* of an insulation casing 30 made e.g. of a resin, thereby projecting the shaft 2*a* of the bolt 2 from the bottom wall 30*a*. Accordingly, a prior art splice connection is unnecessary.

As is clear from the above description, only the electrical contact portions, which are flat surfaces of the cramping terminals at the ends of the wires, can be put together on the terminal table in the insulation casing and, at the same time, the wires, which are unflat portions, can be arranged dispersedly in the respective wire insertion slots. Further, the electrical contact portions of the respective cramping terminals are put together by alternately inserting the wires into the plurality of wire insertion slots, with the result that the wires inserted into one wire insertion slot do not interfere with each other since they are spaced apart by the thickness of the electrical contact portion of the cramping terminal of the wire inserted into the other wire insertion slot.

Accordingly, the number of wires connectable with one bolt can be increased; a cost for parts can be reduced; and a connection operability can be improved.

Further, the LA terminal is held by the nut while being pressed against the terminal table by the LA terminal. Therefore, the electrical contact portions of the plurality of cramping terminals fitted down on one bolt can be engaged closely.

Furthermore, if the number of wire insertion slots is equal to the smaller one of an integer obtained by rounding up a quotient of the largest thickness of barrel portions of the terminals divided by the smallest thickness of electrical contact portions and the number of wires to be inserted, the wires can be arranged effectively in a minimum possible number of wire insertion slots, making the construction of the joint device simpler.

What is claimed is:

1. A joint device for an automotive wiring harness having wires terminals connected to ends of the respective wires, the terminals having electrical contact portions with mount holes, the joint device comprising:

a casing having a bottom wall, a side wall extending from the bottom wall and an upper wall, a plurality of wire insertion slots formed at least in the side wall, said wire insertion slots being open to the upper wall and extending toward the bottom wall of the casing at predetermined intervals for introducing a plurality of wires thereinto, a terminal insertion opening communicating with the wire insertion slots, a bolt having a shaft projecting from the bottom wall and into the casing, a nut engageable with the shaft, and a terminal table with a through hole, the terminal table being mounted in the casing such that the shaft of the bolt extends through the through hole, wherein the terminals are insertable between the upper wall and the terminal table through the terminal insertion opening such that the mount holes of the terminals are fittable on the bolt shaft and the wires are insertable into the wire insertion slots such that fastening of the nut to the bolt shaft secures the electrical contact portions of the terminals at the ends of the plurality of wires in electrical contact with one another.

2. A joint device according to claim 1, further comprising a spring mounted on the bolt shaft.

3. A joint device according to claim 2, wherein spring is between the bottom wall of the casing and the terminal table such that the spring biases the terminal table towards the upper wall of the insulation casing, and the nut being fastened to the bolt shaft with the electrical contact portions of the terminals at the ends of the plurality of wires being secured between the terminal table and the nut.

4. A joint device according to claim 3, wherein the width of the plurality of wire insertion slots is equal to or larger than the diameter of the wires, the plurality of wires being alternately inserted into the respective wire insertion slots.

5. A joint device according to claim 1, wherein the terminal insertion opening is formed in the upper wall of the insulation casing.

6. A joint device according to claim 1, wherein a bottom through hole is formed in the bottom wall of the insulation casing, the bolt shaft passing through the bottom through hole to ground the plurality of wires.

7. A joint device according to claim 1, wherein the bolt has a head embedded in the bottom wall of the insulation casing in such a manner that the shaft thereof projects into the insulation casing for electrical connection with the plurality of wires.

8. A joint device according to claim 1, wherein the number of wire insertion slots is equal to the smaller one of an integer obtained by rounding up a quotient of the largest thickness of barrel portions of the terminals divided by the smallest thickness of electrical contact portions and the number of wires to be inserted.

* * * * *